US005988557A

United States Patent [19]

Möller et al.

[11] Patent Number: 5,988,557

[45] Date of Patent: Nov. 23, 1999

[54] METHOD AND APPARATUS FOR THE WINDING UP OF A PAPER WEB TO FORM A ROLL

[75] Inventors: Roland Möller, Herbrechtingen; Ralf Preising, Holzkirch; Karl Ruck, Heidenheim, all of Germany

[73] Assignee: Voith Sulzer Papiermaschinen GmbH, Germany

[21] Appl. No.: 08/807,485

[22] Filed: Feb. 27, 1997

[30] Foreign Application Priority Data

Feb. 27, 1996 [DE] Germany ..... 196 07 349

[51] Int. Cl.[6] ..... B65H 19/28; B65H 18/14; B65H 18/26

[52] U.S. Cl. ..... 242/532; 242/541.1; 242/541.5; 242/542.3

[58] Field of Search ..... 242/541.1, 532, 242/541.4, 541.5, 541.6, 542.3, 526

[56] References Cited

U.S. PATENT DOCUMENTS

| | | | |
|---|---|---|---|
| 1,923,670 | 8/1933 | Henson . | |
| 3,471,097 | 10/1969 | Phelps | 242/422.6 |
| 3,857,524 | 12/1974 | Melead et al. . | |
| 5,577,685 | 11/1996 | Junk | 242/547 |
| 5,690,298 | 11/1997 | Ruck | 242/541.6 X |

FOREIGN PATENT DOCUMENTS

| | | | |
|---|---|---|---|
| 0483092 | 4/1992 | European Pat. Off. . | |
| 1513694 | 1/1968 | France . | |
| 3244510 | 3/1990 | Germany . | |
| 3839365 | 5/1990 | Germany | 242/541.5 |
| 4007329 | 1/1992 | Germany . | |
| 4415316 | 11/1995 | Germany . | |
| 4415324 | 11/1995 | Germany . | |
| 1099750 | 1/1968 | United Kingdom . | |
| 1297812 | 11/1992 | United Kingdom . | |

OTHER PUBLICATIONS

Patent Abstracts of Japan, vol. 13, No. 55 (M–795), Feb. 8, 1989 & JP 63 262360 A (Toshin), Oct. 28, 1988.

Patent Abstracts of Japan, vol. 12, No. 454 (M–769), Nov. 29, 1988 & JP 63 180657 A (Toshin), Jul. 25, 1988.

DE 88 14 537.9 (Maschinenfabrik Max Kroenert GmbH & Co.), Mar. 9, 1989.

European Serach Report dated Feb. 17, 1998.

*Primary Examiner*—John Q. Nguyen

*Attorney, Agent, or Firm*—Ostrolenk, Faber, Gerb & Soffen, LLP

[57] ABSTRACT

For winding up of a paper web to form a paper roll, a first reel spool is accelerated to the speed of the web and brought into a first, start-of-winding position in which it forms a nip with a driveable press drum. The beginning of the web of paper is guided around the press drum and is wound onto the first reel spool. When a first layer thickness has been wound, the first reel spool is transferred into a second, complete-winding position and the paper roll is wound up there to its desired layer thickness. During the entire winding process, the press drum or a special press roll are pressed against the winding surface of the developing paper roll, a torque is introduced into the axis of the first reel spool by means of a central drive and the press drum and/or press roll and the first reel spool with the developing paper roll thereon are displaced, preferably exclusively horizontally, without substantial changes in the direction or orientation of those elements. Then a second reel spool is accelerated and brought into the first position before transferring the web to the second reel spool.

21 Claims, 4 Drawing Sheets

METHOD AND APPARATUS FOR THE WINDING UP OF A PAPER WEB TO FORM A ROLL

BACKGROUND OF THE INVENTION

The present invention relates to a method and apparatus for winding up a moving paper web to form a roll. The following references are relevant:

(1) DE 40 07 329

(2) DE 32 44 510

(3) FR 15 13 694

(4) GB 12 97 812

(5) US 19 23 670

(6) EP 0 483 092 A1

(7) U.S. Pat. No. 3,857,524

(8) DE 44 15 324

Winding machines for winding up paper webs can be arranged at the output end of a paper machine to roll the paper web arriving there into a roll (a so-called Pope-type reel). However, those machines are also used to rewind a finished paper roll so as to produce rolls of a very specific winding quality.

In all cases the paper roll should have very specific properties, in particular with regard to the winding hardness. The winding hardness should, in general, drop from a certain initial value to an end value. The drop should be as uniform as possible from the first inside layer to the last outside layer. It should have a certain gradient, i.e., it should not be too steep or too shallow. In no case should the profile of the winding hardness show abrupt changes, e.g. drop suddenly. No radial or tangential stresses, which could impair or destroy the paper web, should occur in the paper roll.

All of the foregoing have been objectives that were never accomplished. Winding machines of known construction instead produce, for instance, paper rolls in which the core is extremely soft or extremely hard and in which towards the end, at about ⅘ of the diameter of the roll, a strong drop in the winding hardness occurs. As a result, the first part, i.e., the extremely soft or hard core, is useless, since the web is compressed in this part and bursts so that this part must be thrown away as waste. In the end region in which the paper roll was not wound up with sufficient hardness, lateral displacement of the layers relative to each other occurs, so that the end sides of the finished roll appear frayed and the edges of the web can be easily damaged.

A poorly structured core with a hardness too great or too small does not permit a proper build-up of the rest of the paper roll. The problem is particularly serious in the case of pressure sensitive papers, for instance non-carbon papers, in which pressing of the reel spool with the developing paper roll present thereon against the shell of the carrier drum for the roll is subject to narrow limits.

In the method according to reference (1) DE 40 07 329 from page 1 herein, the developing paper roll is, as mentioned, displaced in a horizontal direction corresponding to the growth of the roll. The paper roll reaches an enormous weight which can exceed 100 tons. For this reason, the paper roll can, upon its growth, in any event not be pressed against the press drum in such a sensitive manner that variations in the line pressure can be avoided.

Reference (8) DE 44 15 324 from page 1 herein describes a winding machine for winding up of a paper web on a reel spool with a central drive. This machine comprises a winding station, a receiving station and a press roll without a drive. The press roll is continuously applied against the circumference of the secondary roll up to the winding station. The web is conducted in such a manner that it constantly enters the entrance nip without wrapping. The diameter of the press roll is as small as that of a standard web-guide roll. Due to insufficient flexural strength, it is therefore not suitable for the application of line pressures of any desired strength, in particular not for extremely large web widths, i.e., up to about 10 meters.

A special device in this case conveys a secondary reel spool and the press roll coupled with it up to the level of the winding station from which a previously wound paper roll was removed. The lift drive required for this produces an expensive construction.

This reference describes the following method: An empty reel spool is supported, together with a driveless press roll, on a vertical carriage. The reel spool and the press roll can be moved up and down on the carriage. Winding starts on the reel spool in a first upper position. The reel spool is then lowered onto horizontal rails together with the press roll and is moved into a fixed first position on the rails. During these steps, the winding process continues. In this first position, the paper web is wound up to form a complete roll, is brought into a delivery position and is then removed from the machine.

In the method according to reference (8) the reel spool is also initially wound in a first position, then lowered onto the rails where winding is then completed in a second position. Upon the lowering onto the rails, a jolt can occur which affects the circumferential force and again results in irregular winding hardness.

Another important disadvantage of this method is that the paper web is directly introduced into the press nip between the press roll and the reel spool, i.e., without, in this case, wrapping around the press roll. The inventors recognized that this leads to air inclusions between the individual layers of the developing paper roll.

U.S. Pat. No. 3,857,524 (reference 7) discloses a winding machine which operates in accordance with the Pope-type reel principle. A Pope-type reel in this case starts a first reel spool. As an alternative, a reel spool-starting device or "acceleration device" (column five, lines 61 to 67) is provided. The reel spool is swung around the circumference of the Pope-type reel and arrives on horizontal rails whereby it is pressed against the Pope-type reel. After cutting the moving web, the winding process on the reel spool commences. The Pope-type reel transmits a torque to the circumference of the reel spool and the developing paper roll. The winding up takes place, in this case, exclusively by application of force acting on the circumference. As soon as the paper reel is full, it is removed, driven by an "enveloper roll 31", from the Pope-type reel to create space for a following empty reel spool. The disadvantage of this machine is similar to that of the machine according to reference (1). In addition, there is no central drive for the reel spool. As a result, development of the winding hardness cannot be controlled as desired. Furthermore, the web tension between the Pope-type reel and the paper roll removed therefrom for cutting the web cannot be controlled as desired.

EP 0 483 092 A1 (reference 6) discloses the following method: An empty reel spool is accelerated to the speed of the web, is then placed on horizontal rails, is pressed against a "winding cylinder" and the leading end of the web is fed onto the empty reel spool. The paper web is then wound up until it forms a complete roll. The winding cylinder is in this case stationary, while the reel spool with the developing roll of paper is displaced on the rails to an extent corresponding to the growth of the paper roll. In this connection, a central drive and a circumferential drive act on the roll. Once the roll is completed, it is brought into a delivery position and is removed from the machine, while a new reel spool is accelerated and lowered onto the rails. Also in this case (as with references 1 and 7) it is not possible to set the line pressure between the winding cylinder and the developing paper roll to any desired values a sufficiently sensitive manner.

SUMMARY OF THE INVENTION

The present invention proceeds from EP 0 483 092 A1, which discloses a winding machine in which the winding up is primarily caused by a central drive.

The object of the invention is to develop a method and a device for winding up a moving paper web so that the winding hardness of the paper roll has the desired profile from the beginning to the end of the winding process, i.e., so that the winding hardness is controlled at any point during the winding process. In other words, the profile of the winding hardness is to be adjustable as desired as the diameter of the roll increases. For instance, that profile is to be constant or slightly increasing or (preferably) slightly decreasing but always continuous. In most cases the core region requires a particularly high winding hardness but sometimes also a relatively low one (see the U.S. Patent Application which corresponds to German Patent Application 19 522 975.4 and to WO 97/01502). In this case, it is to be possible to influence the winding hardness when that is required also without the application of a line pressure between the developing paper roll and the shell of the press roll. Stated differently, it should be possible to set the torque of the rotation drive for the central reel spool drive and to set the line pressure independently of each other within wide limits.

An additional object is to enable adjustment of the longitudinal tension of the moving web again independently of the other variables. Nevertheless, the machine expenditure is of course to be kept as small as possible.

This object is achieved by the method of the invention for winding up of a paper web to form a paper roll. A first reel spool is accelerated to the speed of the web and is brought into a first, start-of-winding position in which it forms a nip with a driveable press drum. The beginning of the web of paper is guided around the press drum and is wound onto the first reel spool. When a first layer thickness of at least 0.1 times the final desired layer thickness or preferably at least 0.3 times that thickness has been wound, the first reel spool is transferred into a second, complete-winding position and the paper roll is wound up there to its desired layer thickness. During the entire winding process, one or both of the press drum or a special press roll are pressed against the winding surface of the developing paper roll, a torque is introduced into the axis of the first reel spool by means of a central drive and the press drum and/or press roll and the first reel spool with the developing paper roll thereon are displaced, preferably exclusively horizontally, without substantial changes in the direction or orientation of those elements. Then a second reel spool is accelerated and brought into the first position before transferring the web to the second reel spool.

The inventors first recognized that the poor quality of paper rolls produced on known winding machines may be due to any of a number of disturbing influences:

swinging of the reel spool along the circumference of the drum during the winding process, jolt-like placing of the reel spool with the started winding onto the guide rail, jolts and thus irregularities caused by the transfer of the reel spool from the primary lever pair to the secondary lever pair, and irregularities upon changing of the drives.

One important discovery is that the properties of the finished paper roll are created to a decisive extent during the first phase of the winding up. The inventors furthermore recognized that even the slightest irregularities upon the winding up can be extremely harmful if irregularities occur during the first phase. Such irregularities can include, for instance, in winding up of the paper roll which starts at a first station, the paper roll then being brought to a second station and the winding being completed at the second station if shocks occur during this.

All of this is avoided by using the invention. During the critical start-up phase of the winding, the developing paper roll is held absolutely quiet and free of any jolts. Once the layer of paper wound up on the reel spool has reached a certain thickness, for instance 0.2 times the desired layer thickness, the reel spool can be transferred to a position for completion of the winding up without impairing the winding quality. Any upward and downward movement is also dispensed with, contrary to the method according to reference (8).

In one variant, the reel spool with the developing paper roll remains constantly in the same "winding position". The machine is extremely simple in all its variants. Furthermore, the inventors consistently focussed on the central drive of the roll being wound, which is the most important means to control the profile of the winding hardness during the winding. This has the advantage that, because the torque is centrally applied, a "wound-in" web tension is produced which is completely continuous and which can be kept constant or can be varied continuously during the entire winding process. Therefore, no abrupt changes occur in the web tension so that the winding hardness is kept under control during the entire winding up since it can be set at any desired value. Differing from reference (8), the press roll is developed as a flexurally stiff "press drum" and is provided with a drive. This achieves two things: the "wound-in" web tension can be regulated in a particularly sensitive manner by controlling both drives. Independently the line pressure between the press drum and the paper roll can be set at any desired value within wide limits, for instance between 0.2 and 3.0 kN/m and therefore, if desired, also at very low values.

In the invention, the proven central drive has been used with simultaneous application of a line pressure which acts on the shell of the developing paper roll, namely by means of the press drum.

In detail, the inventors recognized the following: The line pressure to be applied on the shell of the paper roll has an enormous influence on the result of the winding. The smallest changes in this line pressure have disproportionate influence on the winding hardness. Sharp deflections of the roll during the winding, particularly during the start of the winding, are harmful. Such deflections are avoided with the invention.

Furthermore, during the winding process, the paper roll remains essentially in one place, either in the start-up winding position or in the position for completion of the winding. Only the press drum is displaced corresponding to the growth of the paper roll and not the heavy paper roll itself. The pressing is therefore sensitive.

Other features and advantages of the present invention will become apparent from the following description of the invention which refers to the accompanying drawings.

DETAILED DESCRIPTION OF EMBODIMENTS OF THE INVENTION

Figure 1:
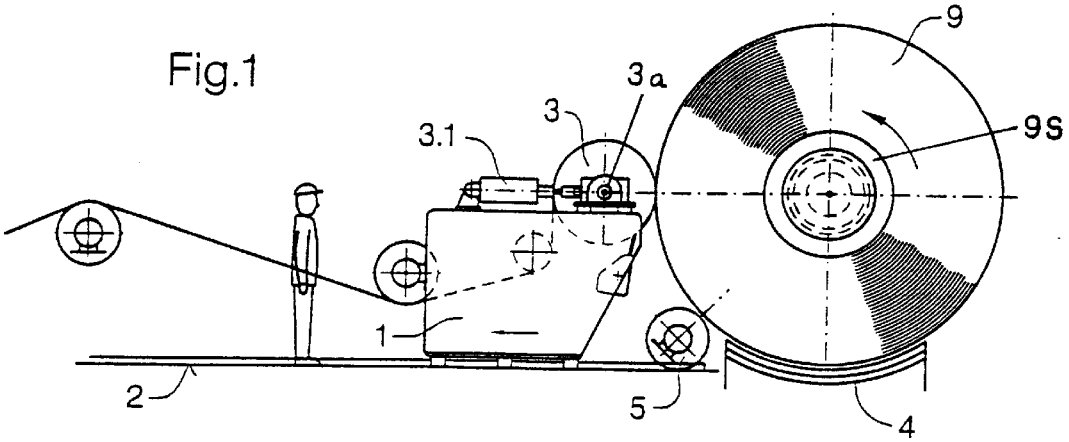
FIGS. 1 to 6 show six different successive operating phases of a first embodiment of a winding machine in accordance with the invention.

The winding machine of the invention comprises a horizontal carriage 1 which can be displaced in a horizontal direction on a guide path 2. The horizontal carriage 1 supports a press drum 3. The drum is provided with a drive. The mounts 3*a* of the press drum 3 can also be displaced horizontally by a short stroke force transmitter 3.1 (like a unit sold under the trademark "Sensomat") on and with respect to the horizontal carriage 1. The horizontal carriage 1 furthermore has a scraper 3.2 for temporarily guiding paper web as waste, i.e., web material that adheres to the drum 3 past the transfer point to the reel, in the downward direction.

At a horizontal distance from the horizontal carriage 1 there is a support device 4 or cradle having a large area support for the developing paper roll 9 on a first spool 9S. In the drawing, the support device 4 is merely shown diagrammatically. It can have different embodiments. Thus, it can, for instance, comprise two rolls which are parallel to the paper roll and which are wrapped around by a supporting belt.

A press roll 5 (also designated first press roll) provided in the region of the support device 4 extends over the entire width of the paper roll 9.

The new reel spool 8 to be emplaced has an associated acceleration device 7 for accelerating that spool. In comprises rolls 7.1, 7.2 and a drive belt 7.3 contacting the spool.

In the operating phase shown in FIG. 1, the paper roll 9 has been almost completely wound up. The horizontal carriage 1 is in its right-hand end position. The press drum 3 is still applied against the circumference of the paper roll 9. The press roll 5, on the other hand, has not yet been applied against the circumference of the paper roll 9.

Figure 2:
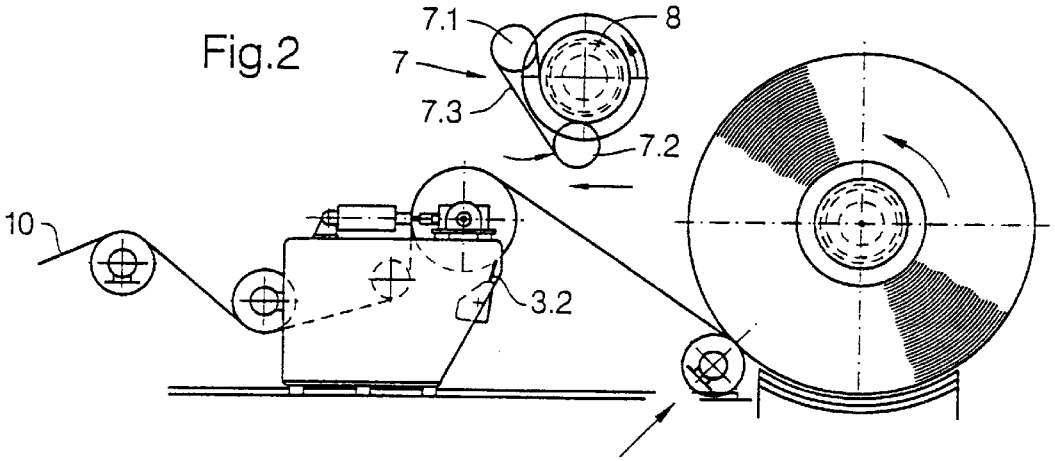

In the phase in FIG. 2, the horizontal carriage has been moved back into its left end, starting position. The press roll 5 had earlier been applied against the circumference of the paper roll 9, prior to the horizontal carriage 1 being moved away, so that there is no period of time when the roll is free of application pressure and one or both of the press drum and press roll are pressing on the outer layer of the paper roll. The new empty reel spool 8 is in a ready position and is being accelerated to the rotation speed of the motion of the paper web 10.

Figure 3:
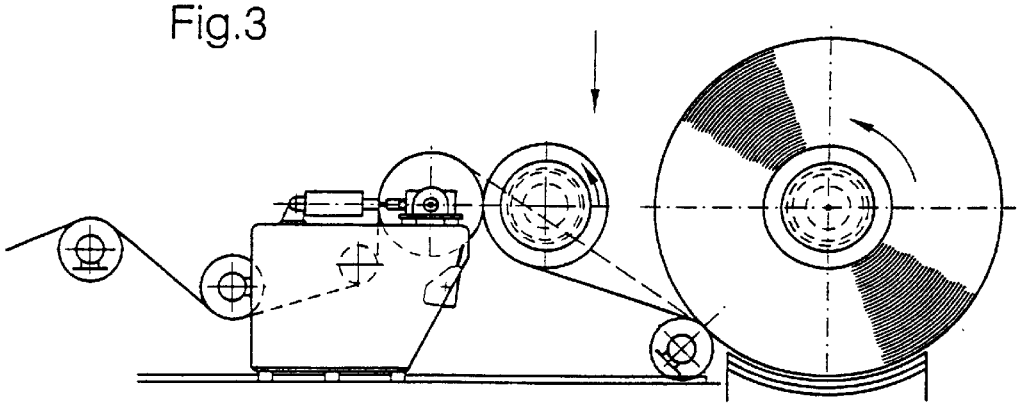

In the phase in FIG. 3, the new empty reel spool 8 is lowered into its operating position. It rests on a pair of spaced apart rails, which are not shown in detail here, but which extend in the horizontal direction and are below the axes of the press drum 3, of the reel spool 8 and of the paper roll 9.

Figure 4:
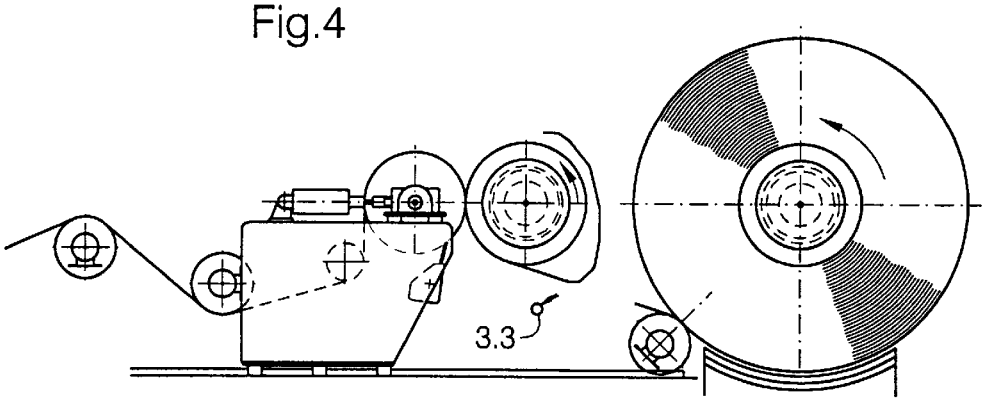

In the phase in FIG. 4, the paper web 10 has been cut enabling the wound reel to be removed from the support device 4 and so that a starting end of the web for the next reel is produced. The starting end of the web is directed onto the reel spool 8 by a blow nozzle on the scraper 3.2 and by an additional blow nozzle 3.3 supported on the frame. The new reel spool 8 stays at and is pressed upon by the drum 3.

Figure 5:
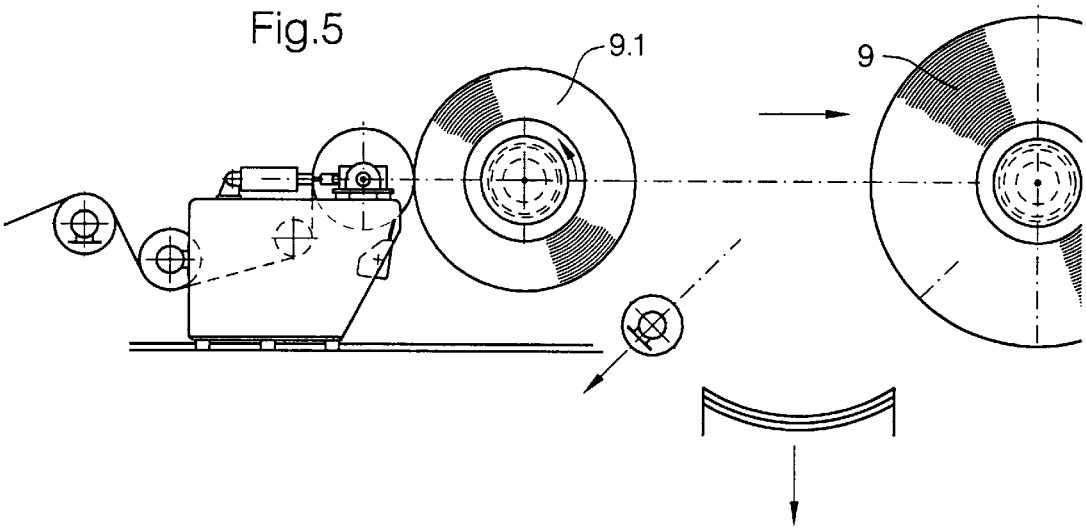

In the phase in FIG. 5, the new paper roll 9.1 still at the drum 3 has reached a certain diameter or layer thickness approaching at least 0.1 times the desired layer of thickness of the web and preferably at least 0.3 times the desired layer of thickness. The finished paper roll 9 has already been removed from the support device 4 and the machine.

Figure 6:
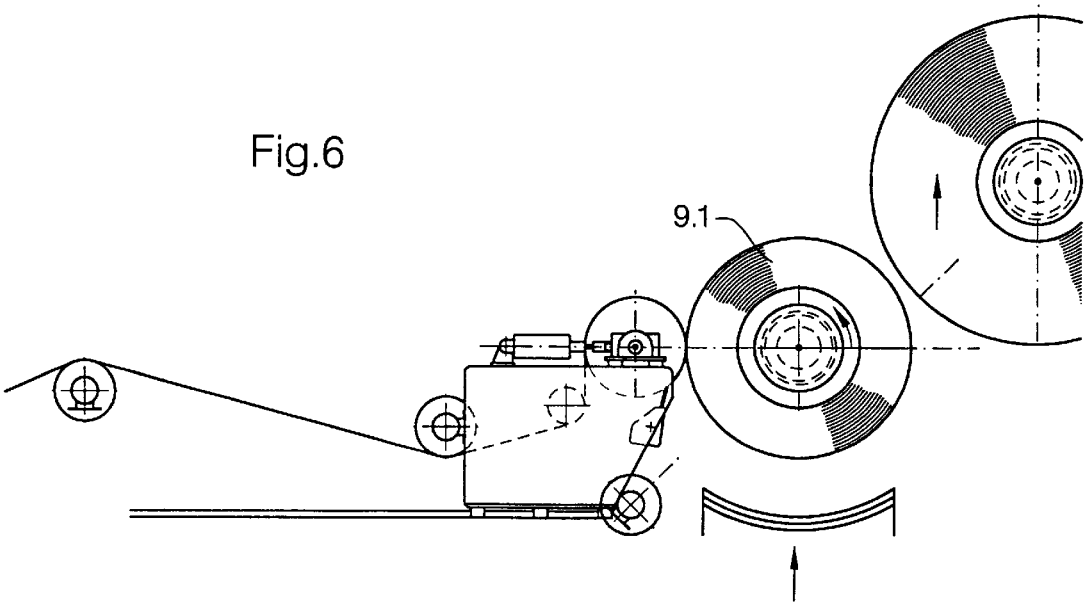

In the phase in FIG. 6, the new developing paper roll 9.1 at the thickness noted above has been moved to the right on the rails into the position for complete winding on the support device 4. The horizontal carriage 1 with the press drum 3 follows the rail guided motion of the roll 9.1 so that the peripheral surfaces of the developing paper roll 9.1 and of the press drum 3 constantly rest against each other. The support device 4 moves up to the new roll.

Figure 7:
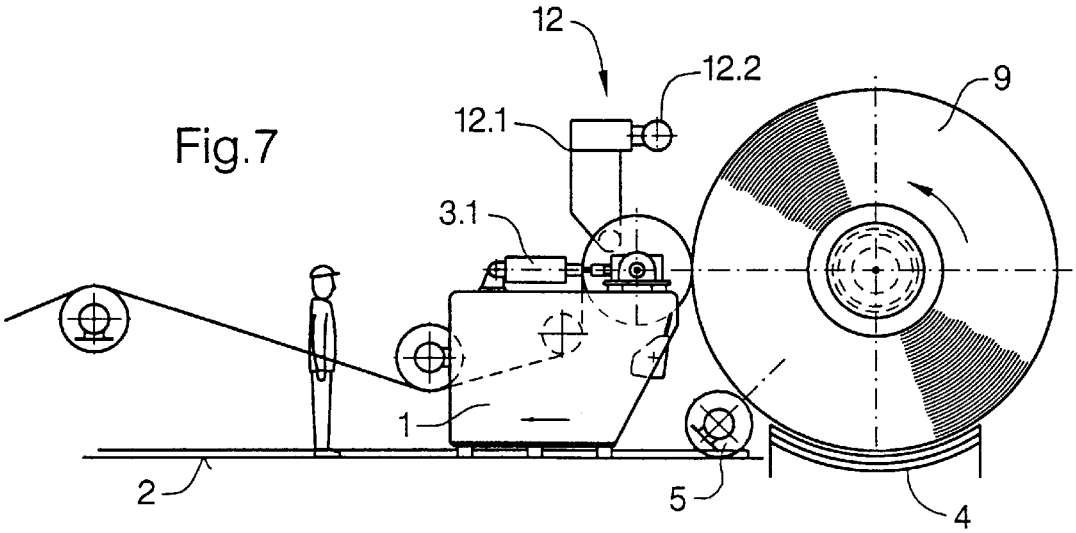
FIGS. 7 to 9 show successive operating phases of a second embodiment.
Figure 8:
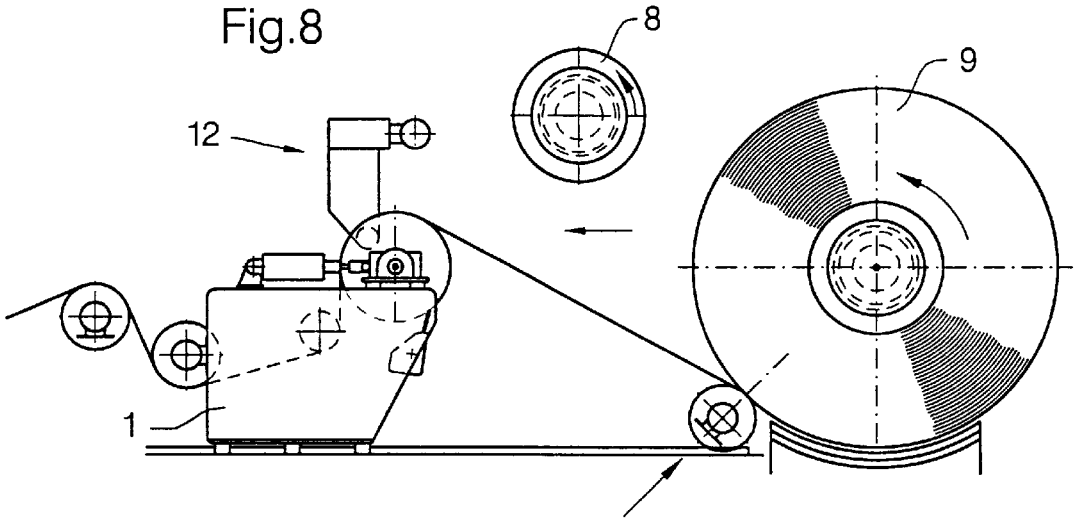
Figure 9:
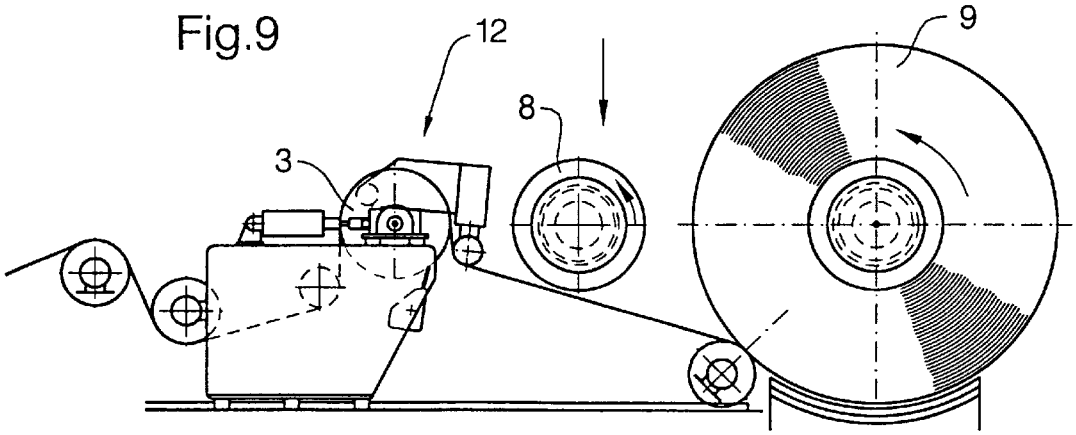

In the alternate embodiment of FIGS. 7 to 9, the winding machine is equipped with a hold-down device 12. It comprises a swivel arm 12.1 with a hold-down roller 12.2 at one end and a curved connection at the other end. FIGS. 7 to 9 illustrate three different operation phases. In the phase in FIG. 7, the hold-down device has been swung into its non-operating position.

In the phase in FIG. 8, the horizontal carriage 1 and the finished paper roll 9 have been separated from each other in horizontal direction by leftward movement of the carriage 1, producing an intermediate space for receiving a new reel spool 8 being lowered in.

In the phase in FIG. 9, the hold-down device 12 has been swung down into its operating position in which it holds down the paper web 10. This makes it possible to lower the new empty reel spool 8 onto the rails without the web winding on the spool 8 having been previously started.

It is thus possible to now couple the spool 8 to a central drive. The drive then accelerates the empty reel spool 8 to the speed of the machine. Then the hold-down device 12 is swung upward again. At the same time, the horizontal carriage 1 moves so that press drum 3 and the reel spool 8 come into contact and a new winding process according to FIGS. 4 to 9 can take place.

Figure 10:
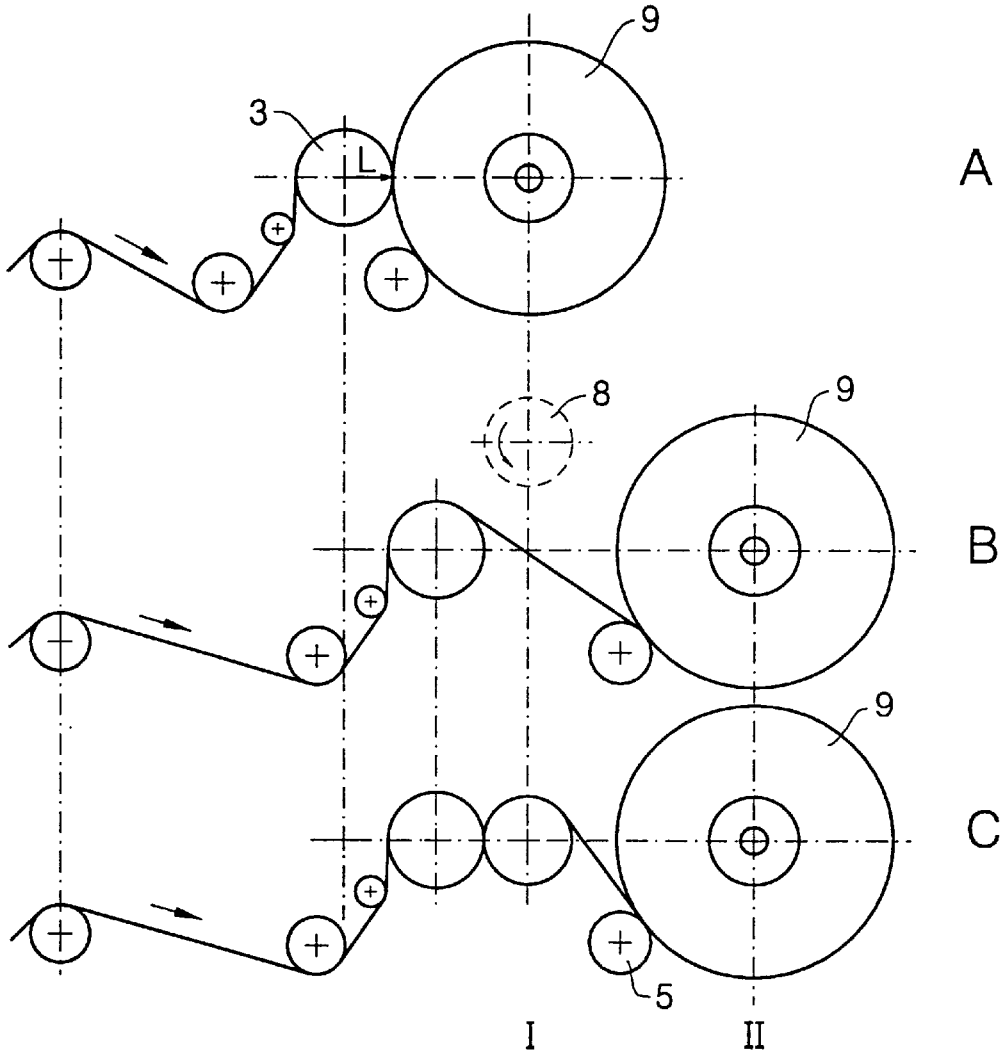
FIGS. 10 and 11 schematically illustrate embodiments in successive phases.

FIG. 10 illustrates the three phases A, B and C of the winding process. The positions of the developing paper roll and of the finished paper roll respectively are designated I and II.

Phase A shows the winding up of a roll shortly before its completion. The paper roll 9 is still in the winding position.

In phase B, the paper roll 9 is in its end position. A new empty reel spool 8 is being accelerated to the speed of the web.

In phase C, the empty reel spool 8 has been placed into the winding position.

Figure 11:
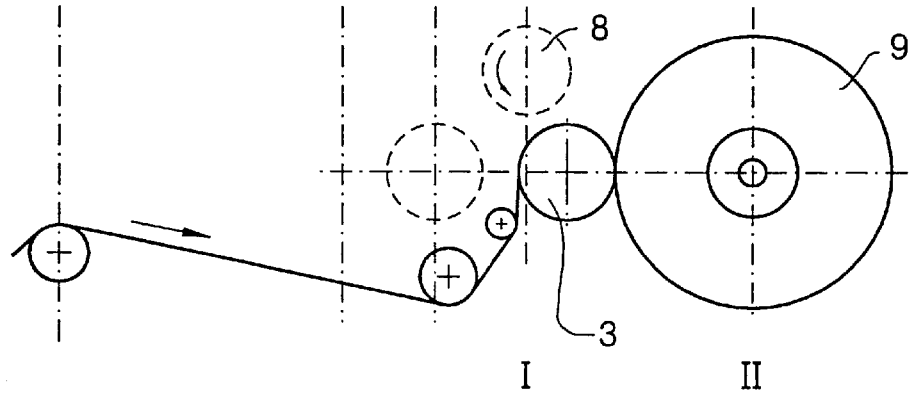

FIG. 11 shows the same object as FIG. 10, but without a press roll 5. In this case, the press drum 3 briefly enters into the end position with the paper roll 9.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A method for winding up a paper web to form a paper roll, the method comprising the steps of:

accelerating a first reel spool to the speed of the web to be wound;

moving the first spool into a first, stationary start of winding position wherein the first spool forms a nip with a rotatable press drum;

guiding the leading end of the web of paper around the press drum to wind onto the rotating first spool;

moving the first spool from the first, stationary start of winding position directly into a second, stationary completion of winding position after the first spool has reached a first wound layer thickness, said second winding position being spaced from said first winding position;

continuing winding the first spool with the web up to a desired layer thickness while the first spool is in the second stationary position while pressing the press drum against the outer winding surface of the paper roll developing on the first spool during substantially the entire winding process after initial contact between the first spool and the press drum;

during the entire winding process introducing a torque into the axis of the first reel spool;

during the entire winding process the press drum is moved relative to the first spool with the paper roll developing thereon without change in directional orientation;

removing the press drum from the paper roll when the paper roll has reached the desired layer thickness;

accelerating a second reel spool to the speed of the web to be wound, and bringing the second reel spool into the first, stationary start of winding position, wherein the press drum forms a nip with the second reel spool; and transferring the web to the accelerated second reel spool in the first, stationary start of winding position.

2. The method of claim 1, wherein the pressing against the outer winding surface of the paper roll is done by pressing the press drum against that surface.

3. The method of claim 1, wherein the pressing against the outer winding surface of the paper roll is done by pressing at least one of the press drum and an additional press roll against that surface.

4. The method of claim 1, further comprising displacing the press drum with reference to the first spool for regulating the line pressure between the press drum and the paper roll.

5. The method of claim 1, wherein the first layer thickness when the first spool is moved to the second position is at least 0.3 times the desired layer of thickness of the completed roll formed on the first spool.

6. The method of claim 1, wherein the first layer thickness when the first spool is moved to the second position is at least 0.1 times the desired layer of thickness of the completed roll formed on the first spool.

7. The method of claim 6, wherein the press drum is displaceable at a speed corresponding to the increase per unit time of the diameter of the winding paper roll.

8. A method of claim 1, further comprising moving a press roll into position to engage the paper roll whenever the press drum is not engaging the paper roll.

9. A of claim 1, further comprising supporting the paper roll developing on the first spool over a large area beneath the developing paper roll at least while the developing paper roll is in the second position.

10. The method of claim 1, wherein the paper roll is displaceable with reference to the press drum during winding only for a change from the first start of winding position to the second complete winding position.

11. The method of claim 10, wherein the displacement of the paper roll is approximately in a horizontal direction.

12. A method for winding up a paper web to form a paper roll, the method comprising the steps of:

accelerating a first reel spool to the speed of the web to be wound and moving the first reel spool into a stationary winding position wherein the first spool forms a nip with a rotatable press drum;

guiding the leading end of the web of paper around the press drum to wind onto the rotating first spool;

maintaining the first spool in the stationary winding position essentially during the entire winding process;

pressing the press drum against the winding surface of the developing paper roll on the first reel spool;

and the press drum being displaceable without change in directional orientation relative to the paper roll for applying and regulating line pressure between the press drum and the developing paper roll by pressing the press drum against the winding surface of the paper roll throughout substantially the entire winding process;

during the entire winding process, introducing a torque into the axis of the first reel spool;

shortly before completion of the winding, moving the first reel spool with the paper roll wound thereon out of the stationary winding position directly into a stationary end position spaced from the stationary winding position wherein completion of winding is performed, accelerating a second reel spool to the speed of the web and then bringing the second reel spool into the stationary winding position wherein the press drum forms a nip with the second reel spool.

13. The method of claim 12, wherein pressing upon the paper roll throughout the winding process is by at least one of the press drum and a press roll.

14. The method of claim 12, further comprising supporting the paper roll developing on the first spool over a large area beneath the developing paper roll at least while the developing paper roll is in the winding position.

15. The method of claim 12, wherein the press drum is displaceable at a speed corresponding to the increase per unit time of the diameter of the winding paper roll.

16. Apparatus for winding up a paper web to form a paper roll, the apparatus comprising:

a first reel spool on which a web is to be wound;

means for supporting the first spool at a first, stationary start of winding position;

means for rotating the first reel spool to the speed of the web to be wound;

web guiding means for guiding the leading end of the web around the rotating first spool;

means for moving the first spool from the first, stationary start of winding position directly to a second, stationary completion of winding position spaced from the first winding position after the first spool has reached a first wound layer thickness and means for continuing rotation of the first spool in the second position;

a rotatable press drum in engagement with the winding surface of the first spool throughout substantially the entire winding process;

a carriage supporting the press drum to be movable toward and away from the first reel spool, the carriage being moveable for retaining the press drum in engagement with the first winding reel spool as the spool moves from the first to the second stationary positions;

the first spool and the press drum being continuously maintained in the same directional orientation as the spool and press drum move relative to each other;

means for accelerating a second reel spool to the speed of the web to be wound and for bringing the second reel spool into the first, stationary start of winding position while the first spool is in the second position, wherein the web guiding means guides a new leading end of the web to the second reel spool.

17. The apparatus of claim 16, further comprising an additional press roll disposed for contacting the first reel spool, and means for moving the additional press roll into contact with the first reel spool such that at least one of the press drum and the additional press roll are in contact with the first reel spool during movement of the first reel spool between the first and second positions and also maintaining contact between the additional press roll and the first spool when the carriage for the press drum has moved the press drum away from the first reel spool for providing space between the press drum and the first reel spool for the second reel spool to contact the press drum.

18. The apparatus of claim 17, further comprising a support for the first reel spool at the second position for supporting the winding paper roll on the first reel spool at the second position.

19. The apparatus of claim 17, wherein the web guiding means guides the web around the press drum and through the nip between the press drum and the first spool.

20. The apparatus of claim 16, further comprising a support for the first reel spool at the second position for supporting the winding paper roll on the first reel spool at the second position.

21. The apparatus of claim 16, wherein the web guiding means guides the web around the press drum and through the nip between the press drum and the first spool.

* * * * *